US011208708B2

(12) United States Patent
Zhang et al.

(10) Patent No.: US 11,208,708 B2
(45) Date of Patent: Dec. 28, 2021

(54) WOLFRAM CARBIDE BASED HARD ALLOY AND ITS PREPARATION METHOD

(71) Applicant: ZHUZHOU CEMENTED CARBIDE GROUP CORP. LTD., Hunan (CN)

(72) Inventors: Hao Zhang, Hunan (CN); Zhongjian Zhang, Hunan (CN); Tao Xu, Hunan (CN); Weibing Zhang, Hunan (CN); Defang Kong, Hunan (CN); Donghua Zhang, Hunan (CN)

(73) Assignee: ZHUZHOU CEMENTED CARBIDE GROUP CORP. LTD., Zhuzhou (CN)

( * ) Notice: Subject to any disclaimer, the term of this patent is extended or adjusted under 35 U.S.C. 154(b) by 858 days.

(21) Appl. No.: 15/744,964

(22) PCT Filed: Nov. 17, 2015

(86) PCT No.: PCT/CN2015/094749

§ 371 (c)(1),
(2) Date: Jan. 15, 2018

(87) PCT Pub. No.: WO2017/020444

PCT Pub. Date: Feb. 9, 2017

(65) Prior Publication Data

US 2018/0209019 A1 Jul. 26, 2018

(30) Foreign Application Priority Data

Jul. 31, 2015 (CN) ..... 201510465155.7

(51) Int. Cl.
*C22C 29/08* (2006.01)
*C22C 1/05* (2006.01)

(52) U.S. Cl.
CPC ..... *C22C 29/08* (2013.01); *C22C 1/051* (2013.01)

(58) Field of Classification Search
CPC ..... C22C 29/08
See application file for complete search history.

(56) References Cited

U.S. PATENT DOCUMENTS 4,956,012 A 9/1990 Jacobs et al.

FOREIGN PATENT DOCUMENTS

| | | |
|---|---|---|
| CN | 103882275 | 6/2014 |
| JP | 08209284 | 8/1996 |
| WO | 2005061746 | 7/2005 |

OTHER PUBLICATIONS

International Search Report for International Application No. PCT/CN2015/094749 dated May 10, 2016.

*Primary Examiner* — Anthony M Liang

(57) ABSTRACT

A wolfram carbide based hard alloy includes a wolfram carbide base having a first binder. A plurality of hard particles with different sizes are dispersed in the wolfram carbide base, and hardness of the hard particles is larger than hardness of the wolfram carbide base.

7 Claims, 2 Drawing Sheets

WOLFRAM CARBIDE BASED HARD ALLOY AND ITS PREPARATION METHOD

CROSS-REFERENCE TO RELATED APPLICATIONS

This application is a 371 national phase of International Application No. PCT/CN2015/094749 filed Nov. 17, 2015 which claims the priority of Chinese patent application CN 201510465155.7, entitled "Wolfram Carbide Based Hard Alloy and its Preparation Method" and filed on Jul. 31, 2015, the entire disclosure of which are incorporated herein by reference.

FIELD OF THE INVENTION

The present disclosure relates to the technical field of metallurgy, and in particular, to a wolfram carbide based hard alloy and its preparation method.

BACKGROUND OF THE INVENTION

As a wear-resistant material, wolfram carbide (WC) based hard alloy has excellent properties such as high hardness, high toughness, high elastic modulus, wear resistance, corrosion resistance and so on, and is widely used in cutting tools, mining tools, wear-resistant and corrosion-resistant components and so on.

In a process of using such a hard alloy, the wear resistance and the toughness thereof are usually concerned. On the one hand, a size of WC particles can be reduced gradually by using a refinement technology of the WC particles in the hard alloy so as to improve the wear resistance of the hard alloy; and on the other hand, the size of the WC particles can be increased gradually by using a coarsening technology of the WC particles so as to improve the toughness of the hard alloy. A super-refining technology and a super-coarsening technology of the hard alloy have achieved a great success, and service life of a product made of the hard alloy is improved to a certain degree.

As the wolfram carbide based hard alloy is used more and more widely, requirements for the wear resistance and the toughness thereof are becoming increasingly high. However, the wear resistance and the toughness of the hard alloy cannot be further improved by the above method. This is because when the WC particles are further refined, the wear resistance of the hard alloy is strengthened, but the toughness of the hard alloy is greatly reduced; and on the contrary, when the WC particles are further coarsened, the toughness of the hard alloy is strengthened, but the wear resistance of the hard alloy is greatly reduced.

SUMMARY OF THE INVENTION

With respect to the above problem, the present disclosure provides a wolfram carbide based hard alloy. According to the present disclosure, the wolfram carbide based hard alloy has very good wear resistance and toughness.

According to a first aspect of the present disclosure, a wolfram carbide based hard alloy is provided. The wolfram carbide based hard alloy comprises a wolfram carbide base including a first binder. A plurality of hard particles with different sizes are dispersed in the wolfram carbide base, and hardness of the hard particles is larger than hardness of the wolfram carbide base.

Since the hardness of the hard particles is larger than the hardness of the wolfram carbide base, when the wolfram carbide based hard alloy is used, the wolfram carbide base is worn quickly so that the hard particles protrude from a surface of the wolfram carbide base. Moreover, the hard particles are different in size, so that sawtooth or waving contact is formed between a surface of the hard alloy and a surface of a material contacted when viewed microscopically. In this way, the hard alloy can carve the surface of the material efficiently, and therefore wear resistance of the hard alloy can be improved. Besides, the hardness of the wolfram carbide base is smaller than the hardness of the hard particles, which means that toughness of the wolfram carbide base is larger than toughness of the hard particles. In this way, even if cracks are generated in the hard particles for performing a carving, the cracks cannot extend through the wolfram carbide base. Instead, energy of extension of the cracks would be absorbed by the wolfram carbide base. Therefore, the hard alloy according to the present disclosure has good toughness.

In one embodiment, the hard particles comprise first hard particles having a first size and second hard particles having a second size. A ratio of the first size to the second size is in a range from 1:5 to 1:7. Since a size of the first hard particles is smaller than a size of the second hard particles, the first hard particles can be filled in space between the second hard particles. Accordingly, hard particles are filled fully in the wolfram carbide base, which helps to improve the wear resistance of the hard alloy. Besides, hardness of the first hard particles is larger than hardness of the second hard particles. The hardness of the second hard particles can be selected according to properties of a material to be processed. The hardness and wear resistance of the wolfram carbide based hard alloy can be further improved by the first hard particles. Meanwhile, the size of the first hard particles is smaller than the size of the second hard particles, and the first hard particles having a small size can be filled in the space between the second hard particles having a large size, which can effectively improve stacking density of the hard alloy.

In a specific embodiment, the first hard particles comprise wolfram carbide and a second binder, and the second hard particles comprise wolfram carbide and a third binder. A weight content of the first binder in the wolfram carbide base is larger than a weight content the second binder in the first hard particles, and the weight content of the second binder in the first hard particles is larger than a weight content of the third binder in the second hard particles. By adjusting contents of binders in the wolfram carbide base, the first hard particles and the second hard particles and sizes of the first hard particles and the second hard particles, it can be achieved that the wolfram carbide base, the first hard particles and the second hard particles are different in hardness. In this way, precise control of the wolfram carbide base, the first hard particles and the second hard particles in hardness can be realized.

For example, the first binder, the second binder and the third binder are all cobalt. A weight content of cobalt in the wolfram carbide base is in a range from 7% to 40%; a weight content of cobalt in the first hard particles is in a range from 6% to 13%; and a weight content of cobalt in the second hard particles is in a range from 5% to 12%. Preferably, the weight content of cobalt in the wolfram carbide base is in a range from 10% to 30%; the weight content of cobalt in the first hard particles is in a range from 8% to 13%; and the weight content of cobalt in the second hard particles is in a range from 5% to 10%. In this way, the size of the first hard particles is much smaller than the size of the second hard particles, and a content of cobalt in the first hard particles is slightly larger than a content of cobalt in the second hard particles. Accordingly, the hardness of the first hard particles is larger than the hardness of the second hard particles. Preferably, measured by Rockwell Scale, a difference between the hardness of the first hard particles and the hardness of the second hard particles is in a range from 1 to 3, and a difference between the hardness of the second hard particles and the hardness of the wolfram carbide base is in a range from 2 to 10.

On the whole, the wolfram carbide based hard alloy comprises 5 wt % to 20 wt % cobalt and 80 wt % to 95 wt % wolfram carbide, and a remaining portion comprises unavoidable impurities. According to different contents of cobalt in the wolfram carbide, the wolfram carbide base having a relatively high content of cobalt, the first hard particles having relatively low contents of cobalt and wolfram carbide, and the second hard particles having lowest contents of cobalt and wolfram carbide are formed. In this way, raw materials of the wolfram carbide base, the first hard particles and the second hard particle are same, and only contents of constituents are different. Therefore, a proportioning process for preparing the wolfram carbide based hard alloy is simplified. In addition, disregistry of interfaces of the first hard particles, the second hard particles and the wolfram carbide base is also relatively low because of same raw materials, which helps to improve the toughness and the wear resistance of the wolfram carbide based hard alloy.

In a preferred embodiment, a weight content of the wolfram carbide base is in a range from 10% to 30%; a weight content of the first hard particles is in a range from 18% to 24%; and a weight content of the second hard particles is in a range from 52% to 66%. For example, the weight content of the wolfram carbide base is 20%; the weight content of the first hard particles is 21%; and the weight content of the second hard particles is 59%. When two types of particles are different in size, small particles can be filled in space between big particles, which is beneficial for improving filling density; and when two types of particles are different in hardness, wear speeds thereof are different, which is beneficial for keeping an operating face sharp.

According to a second aspect of the present disclosure, a method for preparing the above wolfram carbide based hard alloy is provided. A first binder is cobalt, and hard particles comprise first hard particles having a first hardness and a first size and second hard particles having a second hardness and a second size. The method comprises steps of: mixing wolfram carbide powder with cobalt uniformly so as to prepare first particles, mixing wolfram carbide powder with cobalt uniformly so as to prepare second particles, mixing wolfram carbide powder with cobalt uniformly so as to prepare base slurry, coating surfaces of the first particles and surfaces of the second particles with a layer of the base slurry so as to form unit granules, and sintering by hot-pressing a plurality of unit granules so as to obtain the wolfram carbide based hard alloy. The base slurry on surfaces of the first particles and surfaces of the second particles forms a base of the wolfram carbide based hard alloy; the first particles form the first hard particles; and the second particles form the second hard particles. A weight content of cobalt in the first hard particles is larger than a weight content of cobalt in the second hard particles, and the weight content of cobalt in the second hard particles is less than a weight content of cobalt in the base slurry.

In one embodiment, the size of the first hard particles is smaller than the size of the second hard particles. According to the method, since the size of the first hard particles is smaller than the size of the second hard particles, a size of unit granules formed by the first hard particles is also smaller than a size of unit granules formed by the second hard particles. When a plurality of unit granules are sintered by hot pressing, the unit granules having a small size can be filled in space between the unit granules having a big size, which can effectively improve stacking density of the unit granules. In this way, pores within the hard alloy in a sintering process can be avoided effectively, and therefore density of the hard alloy prepared can be improved. In one embodiment, the size of the first hard particles is in a range from 10 μm to 20 μm, and the size of the second hard particles is in a range from 75 μm to 150 μm.

In one embodiment, a temperature of sintering by hot pressing is in a range from 1320° C. to 1350° C., and a pressure thereof is in a range from 80 MPa to 100 MPa. According to the method, the temperature of sintering by hot pressing is lower than a melt temperature of cobalt and a melt temperature of wolfram carbide, and therefore the sintering is actually a solid phase sintering. In such a sintering process, a diffusion trend of cobalt atoms is small. Therefore, contents of the cobalt atoms in the base, the first hard particles and the second hard particles in the hard alloy prepared are almost the same as initial contents of the cobalt atoms in the base slurry, the first particles and the second particles. Therefore, it can be ensured that the first hard particles, the second hard particles and the base are different in hardness.

Compared with the prior art, the present disclosure has following advantages. (1) When hard alloy according to the present disclosure is used, the base is worn quickly so that the hard particles protrude from a surface of the base. Sawtooth or waving contact is formed between the surface of the hard alloy and the surface of the material contacted when viewed microscopically, so that the hard alloy can carve the surface of the material efficiently. In this way, the wear resistance of the hard alloy can be improved. (2) The hardness of the wolfram carbide base is smaller than the hardness of the hard particles, which means that toughness of the wolfram carbide base is larger than toughness of the hard particles. In this way, even if cracks are generated in the hard particles for performing the carving, the cracks cannot extend through the wolfram carbide base. Instead, energy of extension of the cracks would be absorbed by the wolfram carbide base. Therefore, the hard alloy according to the present disclosure has good toughness.

BRIEF DESCRIPTION OF THE DRAWINGS

The present disclosure will be described in a more detailed way below based on embodiments and with reference to the accompanying drawings. In the drawings.

DETAILED DESCRIPTION OF THE EMBODIMENTS

The present disclosure is further explained with reference to the accompanying drawings hereinafter.

Embodiment 1

First particles are prepared. WC powder and Co powder are mixed uniformly with a weight ratio of 90:10 and then are sintered at a temperature of 1400° C. After a sintered product is crushed and sieved, the first particles having a size in a range from 10 μm to 20 μm are obtained.

Second particles are prepared. WC powder and Co powder are mixed uniformly with a weight ratio of 94:6 and then are sintered at a temperature of 1400° C. After a sintered product is crushed and sieved, the second particles having a size in a range from 70 μm to 120 μm are obtained.

Base slurry is prepared. WC powder and Co powder are mixed uniformly with a weight ratio of 4:1, and the base slurry is obtained.

The first particles and the second particles are poured into the base slurry. A weight content of the base slurry is 20%; a weight content of the first particles is 21%; and a weight content of the second particles is 59%. Surfaces of the first particles and the second particles are coated with the base slurry, and unit granules are formed.

Figure 1:
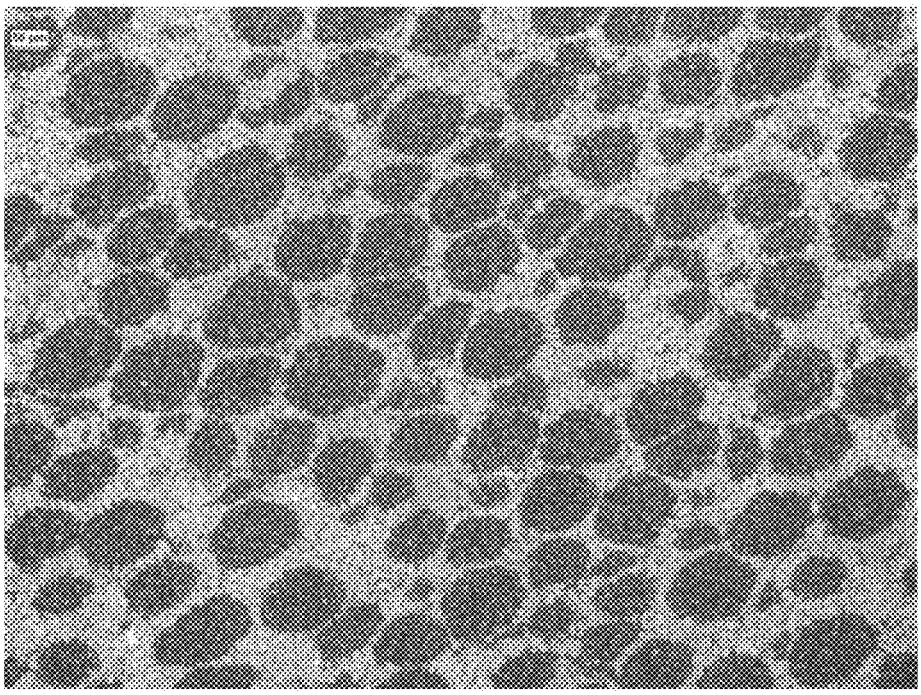
FIG. 1 shows a photomicrograph of a first sample D# of a wolfram carbide based hard alloy according to the present disclosure.

A plurality of unit granules are pressed into a product. Then, a hot isostatic pressing sintering is performed to the product at a temperature of 1320° C. and a pressure of 80 MPa. After the temperature is maintained for 60 minutes, a first sample D# of a wolfram carbide based hard alloy is prepared. A base slurry on surfaces of first particles and the second particles forms a base C# of the wolfram carbide based hard alloy, and the first particles and the second particles respectively form first hard particles A# and second hard particles B#. FIG. 1 shows a photomicrograph of the first sample D#. In FIG. 1, a light portion in a shape of a net is the base, and a dark portion in a shape of a spot represents hard particles. Weight contents of the first hard particles A#, the second hard particles B# and the base C# are further calculated according to the photomicrograph. Such a calculation method is well-known by those skilled in the art, and it will not be described in detail to avoid redundancy. Mechanical properties of the first sample D# are tested, and test results are shown in Table 1. In Table 1, HRA represents Rockwell hardness, and $K_{IC}$ represents fracture toughness.

TABLE 1

| | Co, % | WC, % | HRA | Content in a first sample D#, % | Wear resistance 1/V, $cm^{-3}$ | $K_{IC,MN}^{-3/2}$ |
|---|---|---|---|---|---|---|
| A# | 10 | 90 | 92.0 | 21 | — | — |
| B# | 6 | 94 | 90.0 | 59 | — | — |
| C# | 20 | 80 | 84.2 | 20 | — | — |
| D# | 9.64 | 90.36 | 88.9 | — | 9.8 | 22.6 |

Embodiment 2

First particles are prepared. WC powder and Co powder are mixed uniformly with a weight ratio of 92:8 and then are sintered at a temperature of 1400° C. After a sintered product is crushed and sieved, the first particles having a size in a range from 10 μm to 20 μm are obtained.

Second particles are prepared. WC powder and Co powder are mixed uniformly with a weight ratio of 94:6 and then are sintered at a temperature of 1400° C. After a sintered product is crushed and sieved, the second particles having a size in a range from 70 μm to 120 μm are obtained.

Base slurry is prepared. WC powder and Co powder are mixed uniformly with a weight ratio of 4:1, and the base slurry is obtained.

The first particles and the second particles are poured into the base slurry. A weight content of the base slurry is 10%; a weight content of the first particles is 24%; and a weight content of the second particles is 66%. Surfaces of the first particles and the second particles are coated with the base slurry, and unit granules are formed.

Figure 2:
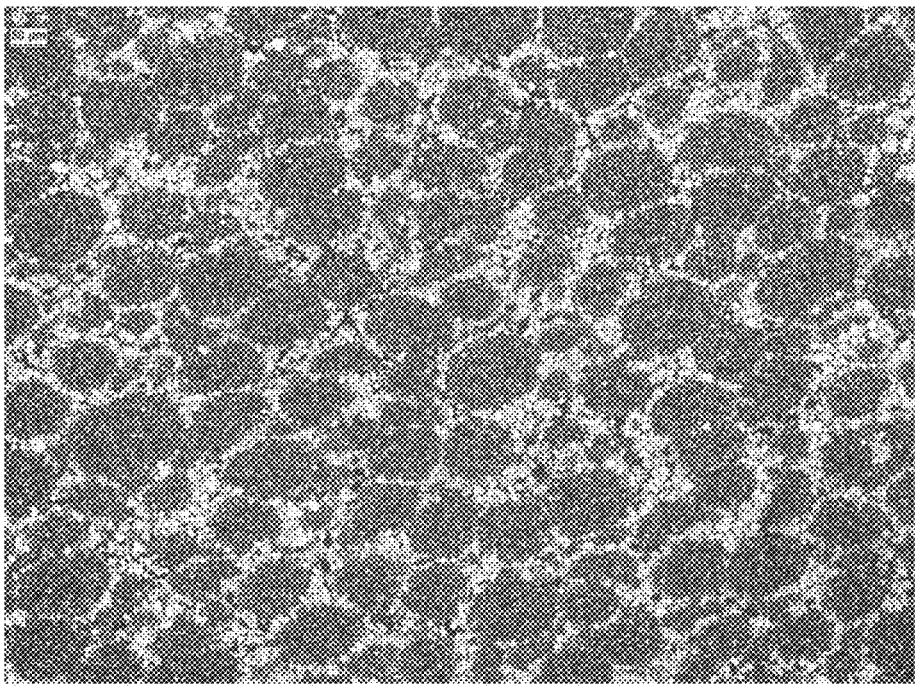
FIG. 2 shows a photomicrograph of a second sample H# of a wolfram carbide based hard alloy according to the present disclosure.

A plurality of unit granules are pressed into a product. Then, a hot isostatic pressing sintering is performed to the product at a temperature of 1330° C. and a pressure of 85 MPa. After the temperature is maintained for 60 minutes, a second sample H# of the wolfram carbide based hard alloy is prepared. A base slurry on surfaces of first particles and the second particles forms a base G# of the wolfram carbide based hard alloy, and the first particles and the second particles respectively form first hard particles E# and second hard particles F#. FIG. 2 shows a photomicrograph of the second sample H#. In FIG. 2, a light portion in a shape of a net is the base, and a dark portion in a shape of a spot represents hard particles. Weight contents of the first hard particles E#, the second hard particles F# and the base G# are further calculated according to the photomicrograph. Such a calculation method is well-known by those skilled in the art, and it will not be described in detail to avoid redundancy. Mechanical properties of the second sample H# are tested, and test results are shown in Table 2. In Table 2, HRA represents Rockwell hardness, and $K_{IC}$ represents fracture toughness.

TABLE 2

| | Co, % | WC, % | HRA | Content in a second sample D#, % | Wear resistance 1/V, $cm^{-3}$ | $K_{IC,MN}^{-3/2}$ |
|---|---|---|---|---|---|---|
| E# | 8 | 92 | 92.6 | 24 | — | — |
| F# | 6 | 94 | 90.0 | 66 | — | — |
| G# | 20 | 80 | 84.2 | 10 | — | — |
| H# | 7.88 | 92.12 | 89.8 | — | 11.1 | 19.3 |

Embodiment 3

First particles are prepared. WC powder and Co powder are mixed uniformly with a weight ratio of 92:8 and then are sintered at a temperature of 1400° C. After a sintered product is crushed and sieved, the first particles having a size in a range from 10 μm to 20 μm are obtained.

Second particles are prepared. WC powder and Co powder are mixed uniformly with a weight ratio of 94:6 and then are sintered at a temperature of 1400° C. After a sintered product is crushed and sieved, the second particles having a size in a range from 70 μm to 120 μm are obtained.

Base slurry is prepared. WC powder and Co powder are mixed uniformly with a weight ratio of 84:16, and the base slurry is obtained.

The first particles and the second particles are poured into the base slurry. A weight content of the base slurry is 10%; a weight content of the first particles is 24%; and a weight content of the second particles is 66%. Surfaces of the first particles and the second particles are coated with the base slurry, and unit granules are formed.

Figure 3:
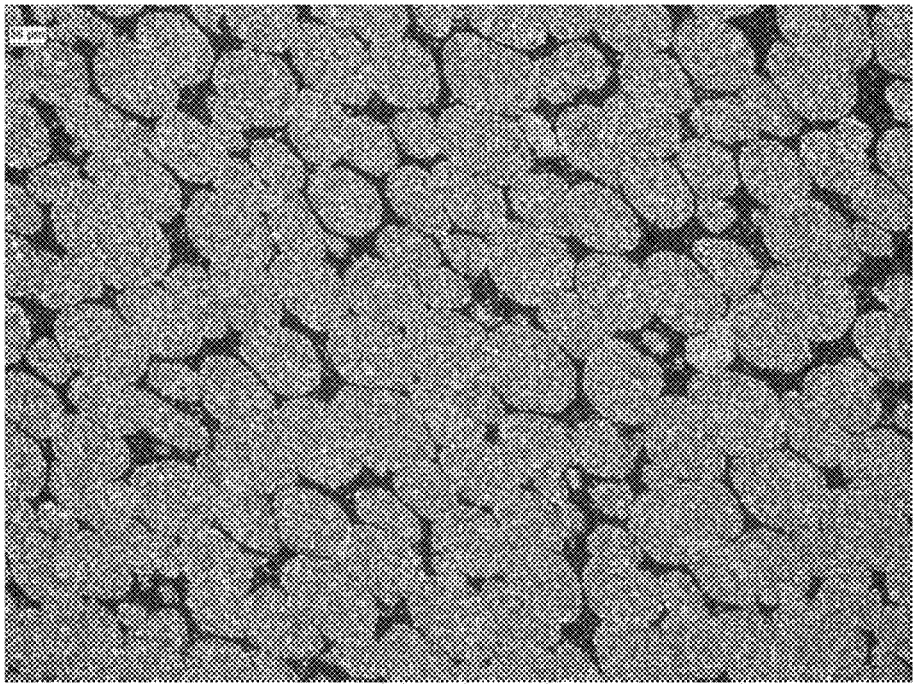
FIG. 3 shows a photomicrograph of a third sample L# of a wolfram carbide based hard alloy according to the present disclosure.

A plurality of unit granules are pressed into a product. Then, a hot isostatic pressing sintering is performed to the product at a temperature of 1340° C. and a pressure of 95 MPa. After the temperature is maintained for 60 minutes, a third sample L# of the wolfram carbide based hard alloy is prepared. A base slurry on surfaces of first particles and the second particles forms a base K# of the wolfram carbide based hard alloy, and the first particles and the second particles respectively form first hard particles I# and second hard particles J#. FIG. 3 shows a photomicrograph of the third sample L#. In FIG. 3, a dark portion in a shape of a net is the base K#, and a light portion in a shape of a spot represents hard particles. Weight contents of the first hard particles I#, the second hard particles J# and the base K# are further calculated according to the photomicrograph. Such a calculation method is well-known by those skilled in the art, and it will not be described in detail to avoid redundancy. Mechanical properties of the third sample L# are tested, and test results are shown in Table 3. In Table 3, HRA represents Rockwell hardness, and $K_{IC}$ represents fracture toughness.

TABLE 3

| | Co, % | WC, % | HRA | Content in a third sample D#, % | Wear resistance 1/V, $cm^{-3}$ | $K_{IC,MN}^{-3/2}$ |
|---|---|---|---|---|---|---|
| I# | 8 | 92 | 92.6 | 24 | — | — |
| J# | 6 | 94 | 90.0 | 66 | — | — |
| K# | 16 | 84 | 86.1 | 10 | — | — |
| L# | 7.48 | 92.52 | 90.3 | — | 12.2 | 15.1 |

Comparative Embodiment 1

A comparative material M# is prepared. According to a method in the prior art, WC powder and Co powder are mixed with a weight ratio of 90.5:9.5, milled, spray-dried and pressed, and then are sintered at a temperature of 1400° C. so as to prepared a comparative sample M#. Properties of the comparative sample M# are shown in FIG. 4. Mechanical properties of the fourth sample M# are tested, and test results are shown in Table 4. In Table 4, HRA represents Rockwell hardness, and $K_{IC}$ represents fracture toughness. Besides, test results of samples obtained in Embodiments 1 to 3 are listed in Table 4.

TABLE 4

| | Co, % | WC, % | HRA | Wear resistance 1/V, $cm^{-3}$ | $K_{IC,\ MN^{-3/2}}$ |
|---|---|---|---|---|---|
| M# | 9.5 | 90.5 | 88.6 | 9.5 | 14.7 |
| D# | 9.64 | 90.36 | 88.9 | 9.8 | 22.6 |
| H# | 7.88 | 92.12 | 89.8 | 11.1 | 19.3 |
| L# | 7.48 | 92.52 | 90.3 | 12.2 | 15.1 |

It can be seen from Table 4 that: the hardness, the wear resistance and the fracture toughness of the wolfram carbide based hard alloy according to the present disclosure are all higher than the wolfram carbide based hard alloy prepared according to the method in the prior art. That is, the wolfram carbide based hard alloy according to the present disclosure has very good wear resistance and toughness.

The present disclosure is illustrated in detail in combination with preferred embodiments hereinabove, but it can be understood that the embodiments disclosed herein can be improved or substituted without departing from the protection scope of the present disclosure. In particular, as long as there are no structural conflicts, the technical features disclosed in each and every embodiment of the present disclosure can be combined with one another in any way, and the combined features formed thereby are within the protection scope of the present disclosure. The present disclosure is not limited by the specific embodiments disclosed herein, but includes all technical solutions falling into the protection scope of the claims.

The invention claimed is:

1. A wolfram carbide based hard alloy, comprising a wolfram carbide base including a first binder, wherein a plurality of hard particles with different sizes are dispersed in the wolfram carbide base, the hardness of the hard particles is larger than the hardness of the wolfram carbide base;

wherein, the hard particles comprise first hard particles having a first hardness and a first size and second hard particles having a second hardness and a second size;

wherein, the first hard particles and the second hard particles are prepared by hot-pressing and sintering unit granules having a layer of a matrix slurry on the surface, wherein the matrix slurry comprises uniformly mixed tungsten carbide powder and cobalt;

in the alloy, a weight percentage of the wolfram carbide base is in a range from 10% to 30%; a weight percentage of the first hard particles is in a range from 18% to 24%; and a weight percentage of the second hard particles is in a range from 52% to 66%.

2. The alloy according to claim 1, wherein a ratio of the first size to the second size is in a range from 1:5 to 1:7.

3. The alloy according to claim 2, wherein the hardness of the first hard particles is larger than the hardness of the second hard particles.

4. The alloy according to claim 2, wherein the first hard particles comprise wolfram carbide and a second binder, and the second hard particles comprise wolfram carbide and a third binder, wherein a weight percentage of the first binder in the wolfram carbide base is larger than a weight percentage of the second binder in the first hard particles, and the weight percentage of the second binder in the first hard particles is larger than a weight percentage of the third binder in the second hard particles;

wherein the first binder, the second binder, and the third binder are all cobalt;

wherein a weight percentage of cobalt in the wolfram carbide base is in a range from 7% to 40%; a weight percentage of cobalt in the first hard particles is in a range from 6% to 13%; and a weight percentage of cobalt in the second hard particles is in a range from 5% to 12%.

5. The alloy according to claim 3, wherein the first hard particles comprise wolfram carbide and a second binder, and the second hard particles comprise wolfram carbide and a third binder, wherein a weight percentage of the first binder in the wolfram carbide base is larger than a weight percentage of the second binder in the first hard particles, and the weight percentage of the second binder in the first hard particles is larger than a weight percentage of the third binder in the second hard particles;

wherein the first binder, the second binder, and the third binder are all cobalt;

wherein a weight percentage of cobalt in the wolfram carbide base is in a range from 7% to 40%; a weight percentage of cobalt in the first hard particles is in a range from 6% to 13%; and a weight percentage of cobalt in the second hard particles is in a range from 5% to 12%.

6. The alloy according to claim 4, wherein the weight percentage of cobalt in the wolfram carbide base is in a range from 10% to 20%; the weight percentage of cobalt in the first hard particles is in a range from 8% to 13%;

and the weight percentage of cobalt in the second hard particles is in a range from 5% to 10%.

7. The alloy according to claim 5, wherein, the weight percentage of cobalt in the wolfram carbide base is in a range from 10% to 20%; the weight percentage of cobalt in the first hard particles is in a range from 8% to 13%; and the weight percentage of cobalt in the second hard particles is in a range from 5% to 10%.

* * * * *